US006157807A

United States Patent [19]

Takenouchi et al.

[11] Patent Number: 6,157,807

[45] Date of Patent: Dec. 5, 2000

[54] CLEANING DEVICE WITH ELECTRICALLY BIASED CONVEYING MEMBERS FOR COLLECTING, SEPARATING AND REUSING DEVELOPER

[75] Inventors: Kouichi Takenouchi, Nabari; Masato Asanuma, Nara; Kouji Shinkawa, Kitakatsuragi-gun; Hiroo Naoi, Nara; Syouichi Fujita, Kashiba, all of Japan

[73] Assignee: Sharp Kabushiki Kaisha, Osaka, Japan

[21] Appl. No.: 09/428,248

[22] Filed: Oct. 27, 1999

[30] Foreign Application Priority Data

Oct. 29, 1998 [JP] Japan ..... 10-308549

[51] Int. Cl.[7] ..... G03G 21/10

[52] U.S. Cl. ..... 399/358; 399/359

[58] Field of Search ..... 399/358, 359, 399/253, 349, 350, 254, 256

[56] References Cited

U.S. PATENT DOCUMENTS 4,588,285 5/1986 Tagoku ..... 399/354

4,601,569 7/1986 Garris ..... 399/358

5,416,572 5/1995 Kolb et al. ..... 399/350

FOREIGN PATENT DOCUMENTS 09251264 9/1997 Japan .

*Primary Examiner*—Joan Pendegrass

*Attorney, Agent, or Firm*—Renner, Otto, Boisselle & Sklar LLP

[57] ABSTRACT

A cleaning device comprises: a first conveying member disposed further upstream in the rotating direction of a photoconductor drum than a cleaning blade, and constructed to rotate in non-contacting relationship to the photoconductor drum to convey residual toner that was removed by the cleaning blade; a second conveying member disposed parallel to the first conveying member and constructed to rotate in non-contacting relationship to the first conveying member; a first bias power supply for applying to the first conveying member a bias voltage having a polarity opposite to the proper polarity of the developer applied for development; and a second bias power supply for applying to the second conveying member a bias voltage having the same polarity as the proper polarity.

8 Claims, 5 Drawing Sheets

FIG. 7A
FIG. 7B
FIG. 7C
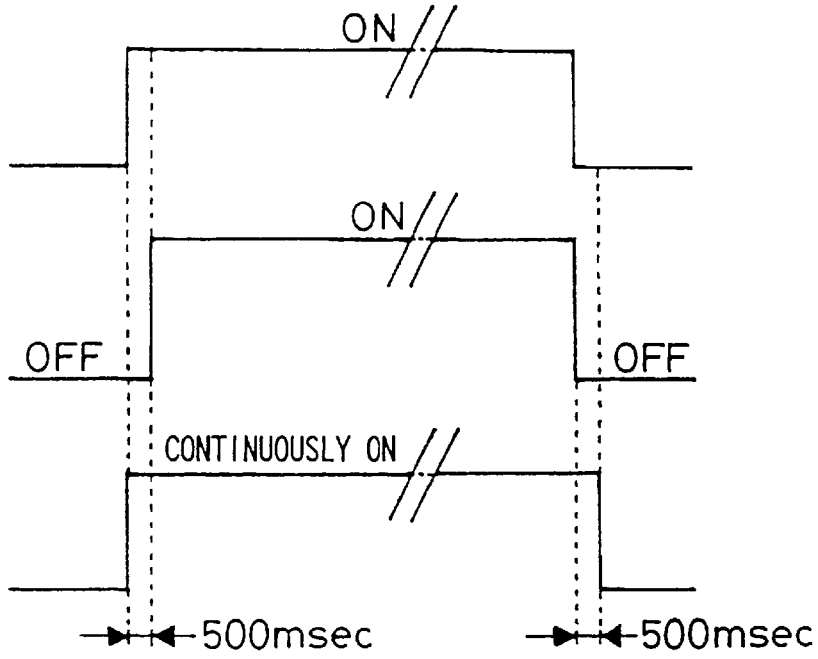
FIG. 8A
FIG. 8B
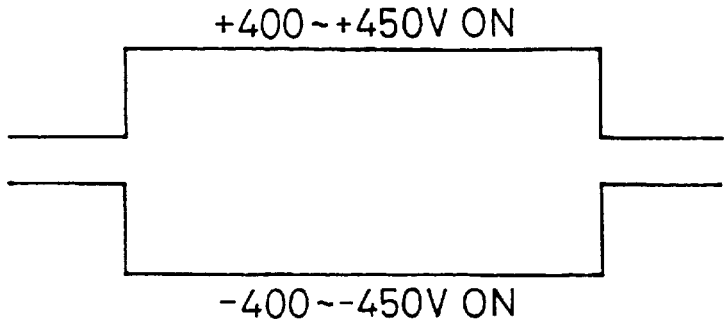

FIG. 9A
FIG. 9B
FIG. 9C
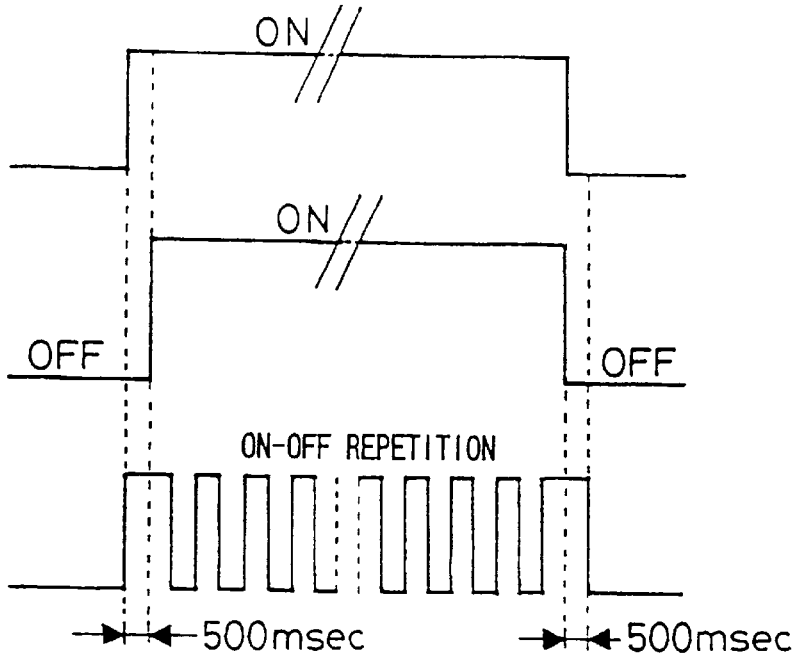
FIG. 10A
FIG. 10B
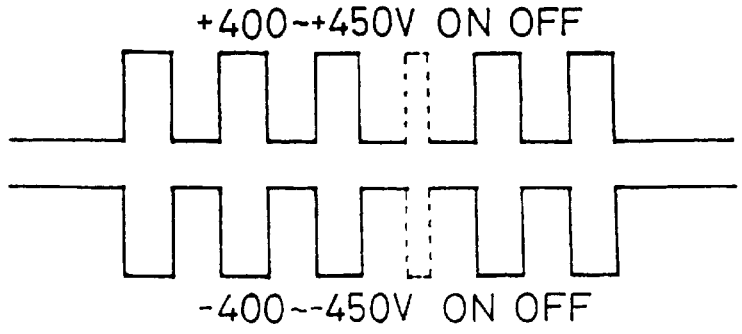

CLEANING DEVICE WITH ELECTRICALLY BIASED CONVEYING MEMBERS FOR COLLECTING, SEPARATING AND REUSING DEVELOPER

BACKGROUND OF THE INVENTION

1. Field of the Invention

In an image forming apparatus for forming an image electrophotographically by transferring a developed image formed on an image bearing member to a transfer medium, the present invention relates to a cleaning device for removing residual developer (residual toner) remaining on the image bearing member by using a cleaning blade.

2. Description of the Related Art

In conventional image forming apparatus such as electrophotographic copiers or printers, an image is formed by performing a series of steps consisting of: a charging step for uniformly and evenly charging an image bearing member, for example, an electrophotographic photoconductor drum; an exposing step for writing an electrostatic latent image to the photoconductor drum; a developing step for developing the electrostatic latent image with toner which is a developer; a transfer step for transferring the developed toner image to paper which is a transfer medium; a fixing step for fixing the transferred toner image to the paper; and a cleaning step for removing residual toner, etc. remaining on the photoconductor drum to prepare for the next cycle of image formation.

Usually, the untransferred toner (residual toner) left on the photoconductor drum from the transfer step is removed using a cleaning blade or a cleaning brush in the cleaning step, and the toner removed from the photoconductor drum is directed from the cleaning device to a toner container for recovery. Previously, the recovered toner was disposed as industrial waste.

However, in recent years, in order to reduce the running costs of image forming apparatus, designs that can extend the lives of components of the apparatus have been studied and commercially implemented.

As an example, Japanese Unexamined Patent Publication JP-A 9-251264 (1997) discloses a toner recycling-type image forming apparatus in which, of the residual toner cleaned off the photoconductor drum, only the toner charged with the polarity proper for development is collected and supplied for reuse into a developing unit for developing an electrostatic latent image on the photoconductor drum.

The cleaning device of the image forming apparatus disclosed in Japanese Unexamined Patent Publication JP-A 9-251264 comprises: a conductive brush roller which is supplied with a bias voltage of the same polarity as the proper polarity in order to remove, from the residual toner on the photoconductor drum, the toner charged with the polarity opposite to the polarity proper for development; a roller-like electrode disposed in contacting relationship to the brush roller and supplied with a bias voltage of the opposite polarity to that applied to the brush roller; and a rubber blade for scraping off the toner adhering to the roller-like electrode.

In operation, the oppositely charged toner is removed using the conductive brush roller by electrostatically attracting such toner away from the photoconductor drum, the toner adhering to the conductive brush roller is electrostatically attracted to the roller-like electrode, and the toner adhering to the roller-like electrode is removed using the rubber blade.

However, according to the above construction, if the developer is a two-component developer consisting of toner and carrier, not only the toner but also the carrier is made to adhere to the photoconductor drum; in particular, in the case of an apparatus employing a reverse development method (the method that makes toner adhere to exposed areas as image areas), if the carrier adhering to the photoconductor drum is removed by the conductive brush roller, it is difficult to completely remove the carrier electrostatically adhering to the conductive brush roller by using the roller-like electrode contacting the end of the conductive brush roller, and as a result, the carrier not removed but left adhering to the conductive brush roller is again adhered to the photoconductor drum, causing a degradation in image quality.

SUMMARY OF THE INVENTION

It is an object of the invention to provide a cleaning device that can improve image quality by preventing foreign matter from adhering to an image bearing member.

To resolve the above problem, the present invention comprises: a cleaning blade, whose tip end is applied in elastically contacting relationship to the surface of an image bearing member on which an image developed with developer supplied from a developing section is held, for removing residual developer remaining on the surface of the image bearing member; a first conveying member disposed opposite the image bearing member and located further upstream in the rotating direction of the image bearing member than the cleaning blade, the first conveying member being constructed to rotate in non-contacting relationship to the image bearing member to convey the residual developer that was removed from the image bearing member by the cleaning blade; a second conveying member disposed parallel to the first conveying member and constructed to rotate in non-contacting relationship to the first conveying member; first bias voltage applying means for applying to the first conveying member a bias voltage having a polarity opposite to the proper polarity in order to make the first conveying member convey and recover the developer by attracting thereto the developer charged with the proper polarity for development; and second bias voltage applying means for applying to the second conveying member a bias voltage having the same polarity as the proper polarity in order to make the second conveying member convey and recover developer and foreign matter charged with a polarity opposite to the proper polarity by attracting the developer and foreign matter thereto.

According to the invention, of the residual toner removed from the image bearing member by the cleaning blade, the developer charged with the proper polarity for development is electrostatically attracted and conveyed by the first conveying member, while the developer and foreign matter charged with the polarity opposite to the proper polarity are quickly moved toward the second conveying member which then conveys the oppositely charged developer and foreign matter by electrostatically attracting them to it; accordingly, not only can the properly charged developer and the oppositely charged developer be efficiently sorted out and conveyed, but also the foreign matter, for example, toner carrier, can be prevented from accumulating near the image bearing member, thus securely preventing the image bearing member from being scratched with the toner carrier.

The first and second bias voltage applying means of the invention apply the bias voltages at the same time that the first and second conveying members are activated, and interrupt the bias voltages at the same time that the first and second conveying members are deactivated.

According to the invention, since the bias voltages are applied at the same time that the first and second conveying members are activated, and turned off at the same time that the first and second conveying members are deactivated, the developer and foreign matter adhering to the first and second conveying members can be removed by abrupt changes in electrostatic force associated with the activation and deactivation of the conveying members; this serves to eliminate the developer, etc. clinging to the conveying members and prevent the conveying capacity from dropping due to the adherence of developer to the conveying members, while at the same time preventing accumulation or agglomeration of developer or foreign matter in the conveying passage.

The first and second bias voltage applying means of the invention apply the bias voltages intermittently while the first and second conveying members are rotating.

According to the invention, by applying the bias voltages intermittently while the first and second conveying members are rotating, the electrostatic force acting on the conveying members varies periodically, generating a vibration effect, and the resulting vibration works to remove the toner and foreign matter adhering to the first and second conveying members; this serves to eliminate the toner, etc. clinging to the first and second conveying members and prevent the conveying capacity from dropping due to the adherence of toner to the conveying members, while at the same time preventing accumulation or agglomeration of toner or foreign matter in the conveying passage.

The invention includes driving means for driving the first conveying member to rotate in the same direction as the rotating direction of the image bearing member, and for driving the second conveying member to rotate in a direction opposite to the rotating direction of the image bearing member.

According to the invention, since the first conveying member is driven to rotate in the same direction as the rotating direction of the image bearing member and the second conveying member to rotate in a direction opposite to the rotating direction of the image bearing member, the properly charged developer and the oppositely charged developer can be sorted out efficiently.

The invention includes driving means for driving the first conveying member to rotate at a speed equal to or higher than the rotational speed of the image bearing member.

According to the invention, since the first conveying member is driven to rotate at a speed equal to or higher than the rotational speed of the image bearing member, the amount of toner conveyed by the first conveying member is larger than the amount of residual toner cleaned off by the cleaning blade, and the cleaned off toner can be securely prevented from accumulating or agglomerating at the first conveying member.

The invention includes driving means for driving the second conveying member to rotate at a speed slower than the rotational speed of the image bearing member.

According to the invention, by driving the second conveying member to rotate at a speed slower than the rotational speed of the image bearing member, the load of the apparatus can be reduced while securing a sufficient capacity to convey the oppositely charged toner whose amount is extremely small compared with the amount of properly charged toner.

In the invention, the first and second conveying members are each formed in a spiral shape, and the valid diameter of the spiral portion of the first conveying member along which the developer is conveyed is made larger than the valid diameter of the spiral portion of the second conveying member along which the developer is conveyed.

In the invention, the first and second conveying members are each formed in the spiral shape, and the pitch of the spiral portion of the first conveying member is made larger than spiral pitch of the spiral portion of the second conveying member.

According to the invention, by making the valid diameter or the pitch of the spiral-shaped first conveying member larger than the valid diameter or the pitch of the spiral-shaped second conveying members, the conveying capacity of the first conveying member can be made larger; this prevents toner accumulation near the image bearing member and improves the collection efficiency of the first conveying member for collecting reusable toner.

BRIEF DESCRIPTION OF THE DRAWINGS

Other and further objects, features, and advantages of the invention will be more explicit from the following detailed description taken with reference to the drawings wherein:

FIGS. 7A to 7C are explanatory diagrams showing the driving signal and bias voltage application timing for the first and second conveying members in the cleaning device of the invention: FIG. 7A shows the driving signal for the first and second conveying members; FIG. 7B shows the driving timing for the first and second conveying members; and FIG. 7C shows the bias voltage signal for the first and second conveying members;

FIGS. 8A and 8B are explanatory diagrams showing the bias voltages applied to the first and second conveying members in the cleaning device of the invention: FIG. 8A shows the bias voltage applied to the first conveying member, and FIG. 8B shows the bias voltage applied to the second conveying member;

FIGS. 9A to 9C are explanatory diagrams showing the driving signal and intermittent bias voltage application timing for the first and second conveying members in the cleaning device of the invention: FIG. 9A shows the driving signal for the first and second conveying members; FIG. 9B shows the driving timing for the first and second conveying members; and FIG. 9C shows the bias voltage signal for the first and second conveying members; and FIGS. 10A and 10B are explanatory diagrams showing the intermittent bias voltages applied to the first and second conveying members in the cleaning device of the invention: FIG. 10A shows the bias voltage applied to the first conveying member, and FIG. 10B shows the bias voltage applied to the second conveying member.

DETAILED DESCRIPTION OF THE PREFERRED EMBODIMENTS

Figure 1:
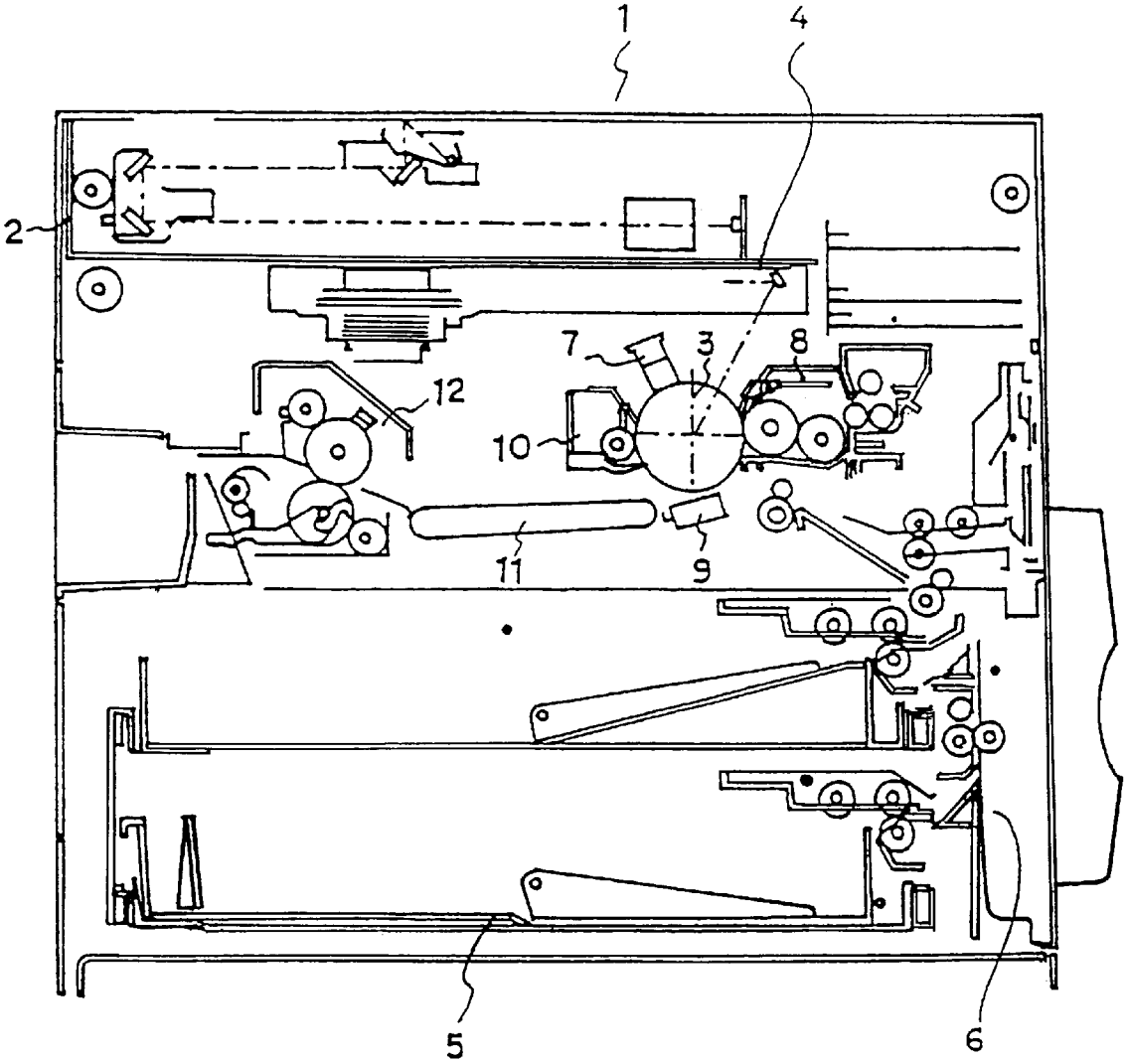
FIG. 1 is a diagrammatic cross sectional view of an image forming apparatus using a cleaning device of the invention.

Now referring to the drawings, preferred embodiments of the invention are described below.

An electrophotographic image forming apparatus using a cleaning device of the present invention will be described with reference to FIG. 1.

In the image forming apparatus, a document reading section 2 for reading an original document is provided in the upper part of a main body 1, and below the document reading section 2 is provided an exposure section 4 which exposes a photoconductor drum 3, the image bearing member, to light corresponding to image information read by the document reading section 2, and thereby forms an electrostatic latent image on the surface of the photoconductor drum 3.

In the lower part of the main body 1, there are disposed: a paper cassette 5 containing paper to which a toner image, the developed image formed on the surface of the photoconductor drum 3, is to be transferred; and a paper feed section 6 for feeding the paper out of the paper cassette 5.

Around the photoconductor drum 3 are arranged, in the order stated below as viewed from the upstream side in the rotating direction of the photoconductor drum 3, a charger 7 for uniformly charging the surface of the photoconductor drum 3, a developing device 8 for developing the electrostatic latent image formed by exposure at the exposure section 4, a transfer unit 9 for transferring the toner image developed by the developing device 8 onto the paper, and a cleaning device 10 for removing residual toner remaining on the surface of the photoconductor drum 3 after transfer by the transfer unit 9.

Further provided are: a transport belt 11 for transporting the paper to which the toner image has been transferred by the transfer unit 9; a fixing device 12 for fixing the thus transferred toner image to the paper transported by the transport belt 11; and a paper exit section for ejecting the paper after the toner image has been fixed to it.

The developing device 8 contains a two-component developer consisting of toner and carrier, and comprises a stirring roller 13 for stirring the two-component developer, a feed roller 14 for feeding, for example, negatively charged toner, and a magnetic roller 15 for applying the negatively charged toner fed from the feed roller 14 onto the photoconductor drum 3 for development.

The cleaning device 10 comprises: a cleaning blade 16 for scraping off residual toner from the surface of the photoconductor drum 3 by applying its tip end in elastically contacting relationship to the surface of the photoconductor drum 3; a first conveying member 17 formed from a conductive material for selectively conveying toner charged with the polarity proper for development out of the toner scraped off into the cleaning device 10 by the cleaning blade 16; and a second conveying member 18 formed from a conductive material for selectively conveying foreign matter and toner charged with a polarity opposite to the proper polarity out of the toner scraped off into the cleaning device 10 by the cleaning blade 16.

The first conveying member 17 is disposed in non-contacting relationship to the photoconductor drum 3 and in close proximity to the cleaning blade 16, and a bias voltage whose polarity is opposite to the proper polarity is applied from a first bias power supply 19 to the first conveying member 17 to electrostatically attract the toner charged with the polarity opposite to the proper polarity.

The second conveying member 18 is disposed outwardly of the first conveying member 17 in non-contacting relationship to the first conveying member 17, and a bias voltage having the same polarity as the proper polarity is applied from a second bias power supply 20 to the second conveying member 18 to electrostatically attract the oppositely charged toner and foreign matter.

The foreign matter here refers to oppositely charged toner and carrier delivered from the developing device 8 and paper dust, rosin, talc, etc. adhered from the paper onto the surface of the photoconductor drum 3 in the transfer area of the transfer unit 9.

The first conveying member 17 and second conveying member 18 are each constructed from a spiral coil or a screw auger or the like, which rotates to convey toner or foreign matter in a direction parallel to its axis of rotation.

In the thus constructed cleaning device 10, the cleaning blade 16 scrapes off the residual toner from the surface of the photoconductor drum 3 into the cleaning device 10.

The scraped off toner is first conveyed with the rotation of the first conveying member 17 to which the bias voltage whose polarity is opposite to the proper polarity is applied from the first bias power supply 19.

At this time, of the scraped off toner, the toner charged with the proper polarity is electrostatically attracted to the first conveying member 17, conveyed in the direction parallel to its axis of rotation, and returned back to the developing device 8 from the cleaning device 10 through a conveying pipe containing a toner conveying spiral coil inside itself.

On the other hand, other toner than the toner charged with the proper polarity by the rotation of the first conveying member 17, that is, the toner charged with the polarity opposite to the proper polarity, and foreign matter are not electrostatically attracted to the first conveying member 17, but are moved toward the second conveying member 18 by the rotation of the first conveying member 17.

At this time, since the second conveying member 18 is supplied with a bias voltage having the same polarity as the proper polarity by the second bias power supply 20, the oppositely charged toner and foreign matter (carrier, paper dust, etc.) are electrostatically attracted to the second conveying member 18, conveyed in the direction parallel to its axis of rotation, and collected in a collecting container (not shown) for storing. The foreign matter is disposed by replacing the collecting container.

Since the second conveying member 18 is disposed farther away from the photoconductor drum 3 than the first conveying member 17 is, as described above, of the residual toner scraped off the photoconductor drum 3 by the cleaning blade 16, the oppositely charged toner and foreign matter are quickly conveyed toward the second conveying member 18 disposed away from the photoconductor drum 3 and away from the photoconductor drum 3, reducing the time during which the carrier and other foreign matter stay in the vicinity of the photoconductor drum 3 and thus minimizing the risk of the photoconductor drum 3 being scratched with the carrier, etc.

Figure 2:
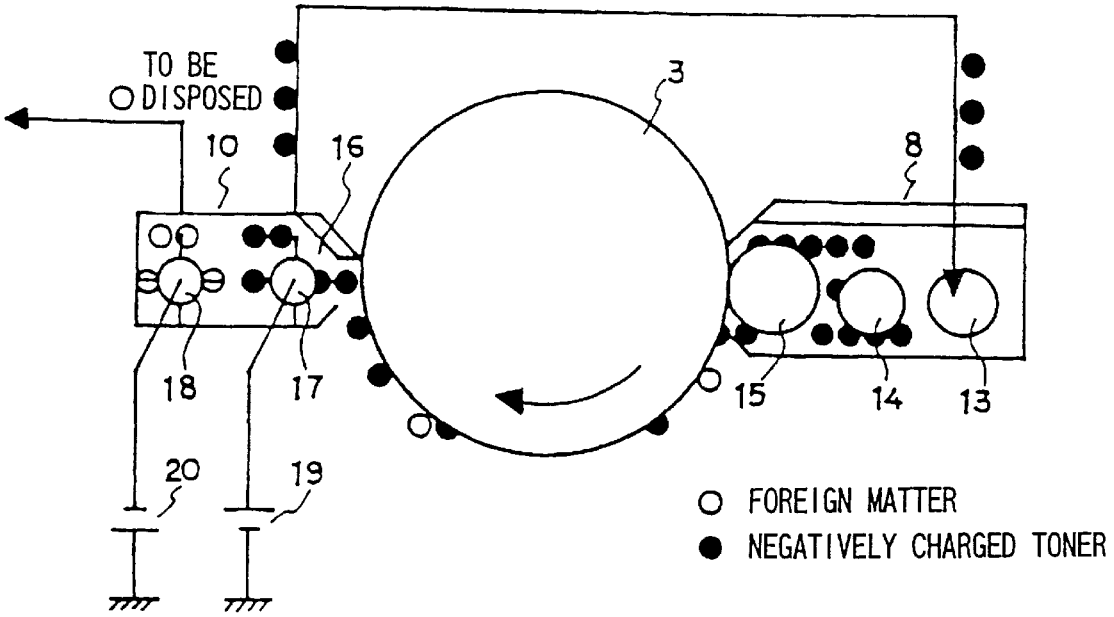
FIG. 2 is a diagrammatic cross sectional view showing an embodiment of the cleaning device of the invention.
Figure 3:
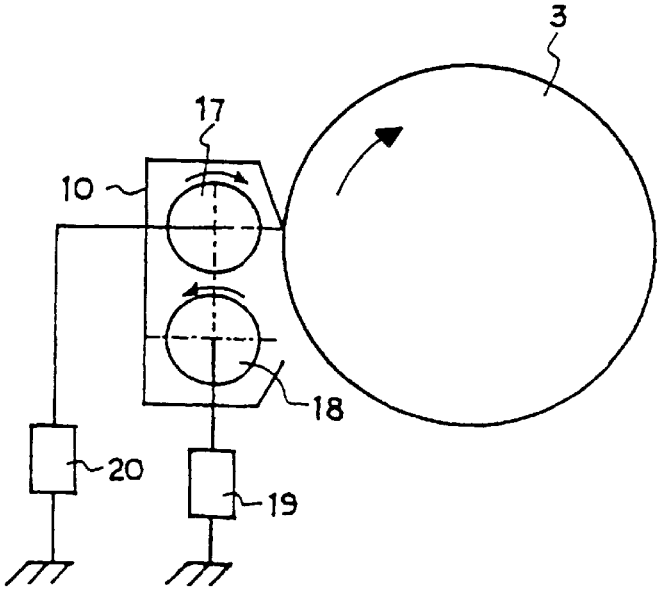
FIG. 3 is a cross sectional view showing an example in which the first and second conveying members are arranged one above the other in the embodiment of the cleaning device of the invention.

In FIG. 2, the first conveying member 17 and second conveying member 18 are laterally arranged, but instead, they may be vertically arranged as shown in FIG. 3.

Figure 4:
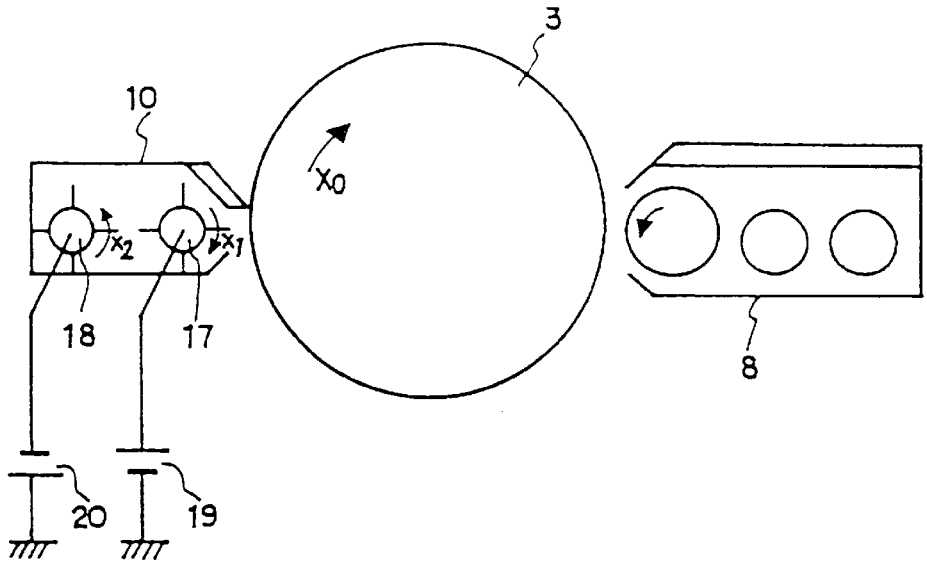
FIG. 4 is a cross sectional view for explaining the rotating directions of the first and second conveying members in the embodiment of the cleaning device of the invention.

Next, the rotating directions of the first conveying member 17 and second conveying member 18 will be explained with reference to FIG. 4. As shown, the first conveying member 17 is driven to rotate in the same direction as the photoconductor drum 3, while the second conveying member 18 is driven to rotate in the opposite direction to that of the photoconductor drum 3 (the first conveying member 17); as a result, the residual toner is efficiently stirred between the first conveying member 17 and second conveying member 18, so that the toners and foreign matter electrostatically attracted to the respective conveying members can be sorted out efficiently.

Further, when the rotational speed X1 of the first conveying member 17 is made equal to or faster than the rotational speed X0 of the photoconductor drum 3, not only can the amount of residual toner collected by the cleaning blade 16 be held within the conveying capacity of the first conveying member 17 but, of the residual toner scraped off by the cleaning blade 16, excess toner not conveyed by the first conveying member 17 can be prevented from accumulating on the cleaning blade 16 or on the first conveying member 17, thus preventing excess toner buildup and agglomeration and maintaining the desired cleaning effect for an extended period of time.

It is appropriate that the rotational speed X1 of the first conveying member 17 at this time be set two to four times the rotational speed X0 of the photoconductor drum 3.

On the other hand, the rotational speed X2 of the second conveying member 18 is made slower than the rotational speed X0 of the photoconductor drum 3.

The reason is that since the amount of oppositely charged toner and foreign matter is extremely small compared with the amount of properly charged toner conveyed by the first conveying member 17, the second conveying member 18 can handle aconveying process if it is rotated at slow speed; this allows a reduction in the load necessary to drive the second conveying member 18, allowing the load of the entire apparatus to be reduced.

Figure 5:
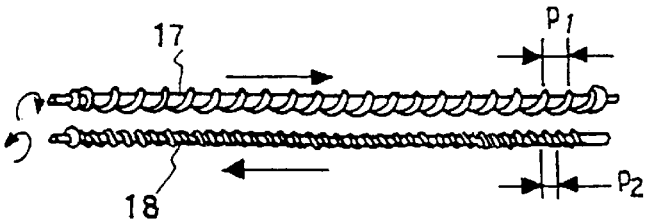
FIG. 5 is a perspective view showing the relationship between the pitches and the valid diameters of the first and second conveying members in the cleaning device of the invention.
Figure 6:
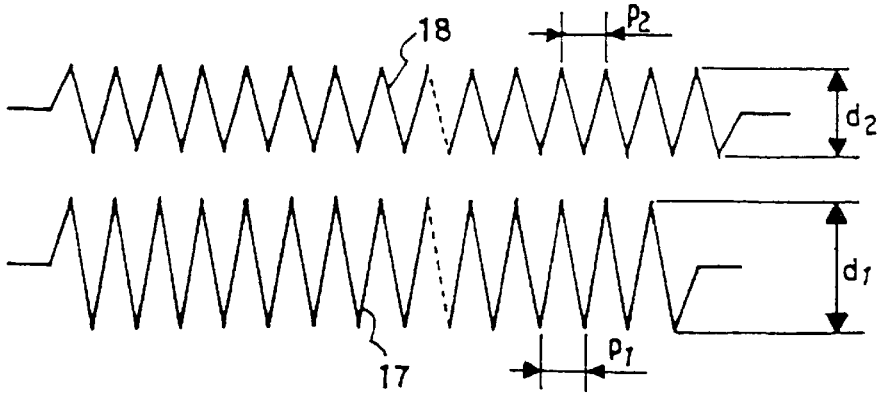
FIG. 6 is a schematic diagram showing the relationship between the pitches and the valid diameters of the first and second conveying members in the cleaning device of the invention.

Referring next to FIGS. 5 and 6, a description will be given of pitches and valid diameters when the first conveying member 17 and the second conveying member 18 are each constructed from a spiral coil or a screw auger.

A pitch P1 of the first conveying member 17 is set larger than a pitch P2 of the second conveying member 18 (P1>P2), and a valid diameter d1 of the first conveying member 17 is also set larger than a valid diameter d2 of the second conveying member 18 (d1>d2).

By constructing the first conveying member 17 and second conveying member 18 in this way, the conveying capacity of the first conveying member 17 can be made larger than the conveying capacity of the second conveying member 18; this prevents toner accumulation near the photoconductor drum 3 and improves the collection efficiency of the first conveying member 17 for collecting reusable toner.

Alternatively, either one of the pitch or the valid diameter of the first conveying member 17 may be set larger than the pitch or the valid diameter of the second conveying member 18; in that case also, the conveying capacity of the first conveying member 17 can be made larger than the conveying capacity of the second conveying member 18.

Further, by setting the rotational speed of the first conveying member 17 faster than the rotational speed of the second conveying member 18, the conveying capacity of the first conveying member 17 can be made larger than the conveying capacity of the second conveying member 18, as in the above case.

Next, the bias voltages applied to the first conveying member 17 and second conveying member 18 will be described with reference to FIGS. 7A to 7C and FIGS. 8A and 8B.

As shown in FIGS. 7A to 7C, the bias voltage application timing for the first conveying member 17 and second conveying member 18 is synchronized to the main driving signal for rotationally driving the first conveying member 17 and second conveying member 18.

In this way, by turning the bias voltages on and off in synchronism with the starting and stopping of the rotation of the first conveying member 17 and second conveying member 18, the toner and foreign matter adhering to the first conveying member 17 and second conveying member 18 can be removed by abrupt changes in electrostatic force associated with the start/stop action; this serves to eliminate the toner, etc. clinging to the first conveying member 17 and second conveying member 18 and prevent the conveying capacity from dropping due to the adherence of toner to the conveying members, while at the same time preventing accumulation or agglomeration of toner or foreign matter in a conveying passage.

Further, by setting the bias voltage applied to the first conveying member 17 at +400 to +450 V and the bias voltage applied to the second conveying member 18 at −400 to −450 V, as shown in FIGS. 8A and 8B, that is, by setting the bias voltages applied to the first conveying member 17 and second conveying member 18 equal in magnitude but different only in polarity, application of the bias voltages can be controlled using simple circuitry.

Moreover, by controlling the bias voltages within the range of 400 to 450 V, a sufficient electrostatic force can be exerted effectively on the toner and foreign matter.

Bias voltages may be applied in intermittent fashion to the first conveying member 17 and second conveying member 18, as shown in FIGS. 9 and 10 during rotational operation of the conveying members. By applying the bias voltages intermittently as shown, the electrostatic force acting on the conveying members varies periodically, and the resulting vibration works to remove the toner and foreign matter adhering to the first conveying member 17 and second conveying member 18; this serves to eliminate the toner, etc. clinging to the first conveying member 17 and second conveying member 18 and prevent the conveying capacity from dropping clue to the adherence of toner to the conveying members, while at the same time preventing accumulation or agglomeration of toner or foreign matter in the conveying passage.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A cleaning device comprising:

a cleaning blade, whose tip end is applied in elastically contacting relationship to the surface of an image bearing member on which an image developed with developer supplied from a developing section is held, for removing residual developer remaining on the surface of the image bearing member;

a first conveying member disposed opposite the image bearing member and located further upstream in a rotating direction of the image bearing member than the cleaning blade, the first conveying member being constructed to rotate in non-contacting relationship to the image bearing member to convey the residual developer that was removed from the image bearing member by the cleaning blade;

a second conveying member disposed parallel to the first conveying member and constructed to rotate in non-contacting relationship to the first conveying member;

first bias voltage applying means for applying to the first conveying member a bias voltage having a polarity opposite to a proper polarity for development in order to make the first conveying member convey and recover the developer by attracting thereto the developer charged with the proper polarity; and second bias voltage applying means for applying to the second conveying member a bias voltage having the same polarity as the proper polarity in order to make the second conveying member convey and recover developer and foreign matter charged with a polarity opposite to the proper polarity by attracting the developer and foreign matter thereto.

2. The cleaning device of claim 1, wherein the first and second bias voltage applying means apply the bias voltages at the same time that the first and second conveying members are activated, and interrupt the bias voltages at the same time that the first and second conveying members are deactivated.

3. The cleaning device of claim 1, wherein the first and second bias voltage applying means apply the bias voltages intermittently while the first and second conveying members are rotating.

4. The cleaning device of claim 1, further comprising:

driving means for driving the first conveying member to rotate in the same direction as the rotating direction of the image bearing member, and for driving the second conveying member to rotate in a direction opposite to the rotating direction of the image bearing member.

5. The cleaning device of claim 1, further comprising:

driving means for driving the first conveying member to rotate at a speed equal to or higher than the rotational speed of the image bearing member.

6. The cleaning device of claim 1, further comprising:

driving means for driving the second conveying member to rotate at a speed slower than the rotational speed of the image bearing member.

7. The cleaning device of claim 1, wherein the first and second conveying members are each formed in a spiral shape, and a valid diameter of the spiral portion of the first conveying member along which the developer is conveyed is made larger than a valid diameter of the spiral portion of the second conveying member along which the developer is conveyed.

8. The cleaning device of claim 1, wherein the first and second conveying members are each formed in a spiral shape, and a pitch of the spiral portion of the first conveying member is made larger than a pitch of the spiral portion of the second conveying member.

* * * * *